United States Patent [19]

Mueller

[11] 4,236,839

[45] Dec. 2, 1980

[54] DEVICE FOR ADJUSTING THE HEIGHT OF A RIBBON GUIDE

[75] Inventor: Wolfgang Mueller, Munich, Fed. Rep. of Germany

[73] Assignee: Siemens Aktiengesellschaft, Berlin & Munich, Fed. Rep. of Germany

[21] Appl. No.: 930,502

[22] Filed: Aug. 3, 1978

[30] Foreign Application Priority Data

Sep. 26, 1977 [DE] Fed. Rep. of Germany ..... 2743256

[51] Int. Cl.[3] ..... B41J 1/32

[52] U.S. Cl. ..... 400/216.1; 400/216.2

[58] Field of Search ..... 400/212, 215, 216.1, 400/216.2; 101/336

[56] References Cited

U.S. PATENT DOCUMENTS

| | | | |
|---|---|---|---|
| 3,237,747 | 3/1966 | Frechette et al. | 400/216.1 X |
| 3,531,592 | 9/1970 | Sandrone | 400/216.1 X |
| 3,595,361 | 7/1971 | Rekewitz et al. | 400/216.1 |
| 3,741,364 | 6/1973 | Becker | 400/216.1 X |
| 3,782,521 | 1/1974 | Hennelhaupt | 400/215 X |
| 3,941,229 | 3/1976 | Becchi et al. | 400/216.1 |
| 4,022,313 | 5/1977 | Lau et al. | 400/212 X |
| 4,073,371 | 2/1978 | Prager | 400/216.2 |

FOREIGN PATENT DOCUMENTS

| | | | |
|---|---|---|---|
| 2146595 | 3/1973 | Fed. Rep. of Germany | 400/212 |
| 2362697 | 6/1975 | Fed. Rep. of Germany | 400/215 |
| 2304477 | 3/1976 | France | 400/212 |

*Primary Examiner*—Edward M. Coven

*Attorney, Agent, or Firm*—Hill, Van Santen, Steadman, Chiara & Simpson

[57] ABSTRACT

A device for business machines, data and teleprinters and the like, for selectively adjusting the height of the ribbon guide thereof, at the printing station, into one of several operating positions and a visibility position in which the printing station of the machine is visible, in which the drive means for effecting movement of the ribbon guide comprises a stepping motor controlled by a drive circuit operative, in response to control criteria, to effect a positioning of the ribbon guide into either of two relatively extreme positions, or automatically into an intermediate position, in the absence of a selection of either such relatively extreme positions.

4 Claims, 4 Drawing Figures

DEVICE FOR ADJUSTING THE HEIGHT OF A RIBBON GUIDE

BACKGROUND OF THE INVENTION

The invention relates to a device for use in business machines, data or teleprinters, and the like, for adjusting the height of the ribbon guide thereof at the printing station, whereby it may assume any one of a plurality of operating positions, or a visibility position in which the printing station of the machine is visible.

Where typewriters are provided with a ribbon which can be used only along a single line or track, relatively simple gearing can be provided to convey the ribbon from such a visibility position into an operating position for the printing of characters. A considerably greater complexity of gearing must be provided if one of two ribbon tracks is to be selectively operable, i.e. for example one track for black imprinting and one track for red imprinting. An equally expensive and complex gear construction is also required for use with carbon ribbons, in which, to effect a better exploitation of the ribbon, it is to be adjustable into a plurality of useful tracks.

Thus, it is known, for example from CH Patent 422,017, to continuously raise the ribbon on various useful tracks starting from the lower or bottom track. The variable range is achieved by means of a ratchet wheel which, with each stop, rotates a gear or wheel by one tooth pitch and thus displaces the translation fulcrum of the structure for effecting the lifting of the ribbon fork by small increments. However, it is also known, for example from U.S. Pat. No. 3,302,766, to alternately adjust the ribbon fork out of a visibility position into one of two levels or positions, which movements are executed by a ratchet wheel and a cam. A device is also known from German Patent No. 1,179,955 in which a cam plate is provided with a plurality of cam faces, one of which is selected by differently adjustable ratchets.

A common feature of all such arrangements is that mechanical gear elements requiring a relatively high production outlay are utilized to perform the functions required to effect an adjustment of the position of the ribbon guide. As a plurality of interengaging gear elements are generally required, disturbances due to mechanical influences and wear are likely. The requisite servicing and possible repair work involved are extremely costly.

BRIEF SUMMARY OF THE INVENTION

The present invention has as one of its principal objectives to provide a device by means of which it is possible to adjust a ribbon into a plurality of operating positions or into a visibility position without a complex mechanical outlay and relatively great expense.

A device fulfilling these requirements, in accordance with the invention, is characterized by the use of a stepping motor, as the drive means for the ribbon guide element, which is operative to effect adjustment of the ribbon into its various positions. The stepping motor can be driven by corresponding drive circuits which are constructed from commercially available digital modules, for example, such as AND-logic-linking gates, OR-logic-linking gates or trigger stages, providing a high degree of freedom in the selection and location of the height adjustment positions for the ribbon which is to be adjusted at the printing station, without the need for elaborate mechanical gear elements. When carbon ribbons are to be utilized, an optimal exploitation is achieved in that the ribbon is transported in stepped fashion upwards, then downwards, and vice versa with corresponding longitudinal feed so that it describes a meandering or serpentine course of travel.

Where the device is adapted to guide a textile ribbon employing two useful tracks which can be optionally actuated during each ribbon cycle, for example one useful track for black printing and one useful track for red printing, the construction, in accordance with the invention, advantageously utilizes a stepping motor as the drive means for effecting selective adjustment of the ribbon guide into any one of three possible adjustment positions, in conjunction with a drive circuit for the stepping motor, which circuit can be supplied with control criteria in dependence upon which it is possible to selectively dispose the ribbon guide into either of two of the possible three adjustment positions from the third adjustment position, which by means of the circuit arrangement is automatically assumed.

In accordance with a further development of the invention, a scanning element may be provided which is cooperable with means suitably coordinated with the movement of the ribbon guide which, when a predetermined adjustment position is assumed, supplies a corresponding control criterion to the drive circuit driving the stepping motor.

Particularly in the case of business machines, data and teleprinters which are to be operated without personally attendant operators, the device may be so designed that the adjustment position which the ribbon guide automatically assumes is the central position of the three adjustment positions which the ribbon guide can assume. On the other hand, it is advantageous for the scanning element to emit the control criterion when the adjustment position is assumed which provides visibility of the printing station.

The use of a stepping motor to actuate the ribbon guide into any of the adjustment positions, under the control of electronic drive circuit means, enables the production of a ribbon arrangement which offers a visibility position and two further adjustment positions for two respective useful tracks of the ribbon, with the individual adjustment positions being effected with arbitrarily selected priority. The possibility of selecting the central of the three possible adjustment positions as the basic setting which is adapted to be automatically obtained, in which, for example, the black ribbon track is operatively disposed in recording position, results in a situation in which any defect in the ribbon switching mechanism will not necessarily lead to the breakdown of the entire printing device.

BRIEF DESCRIPTION OF THE DRAWINGS

In the drawings wherein like reference characters indicate like or corresponding parts.

DETAILED DESCRIPTION OF THE INVENTION

Figure 1:
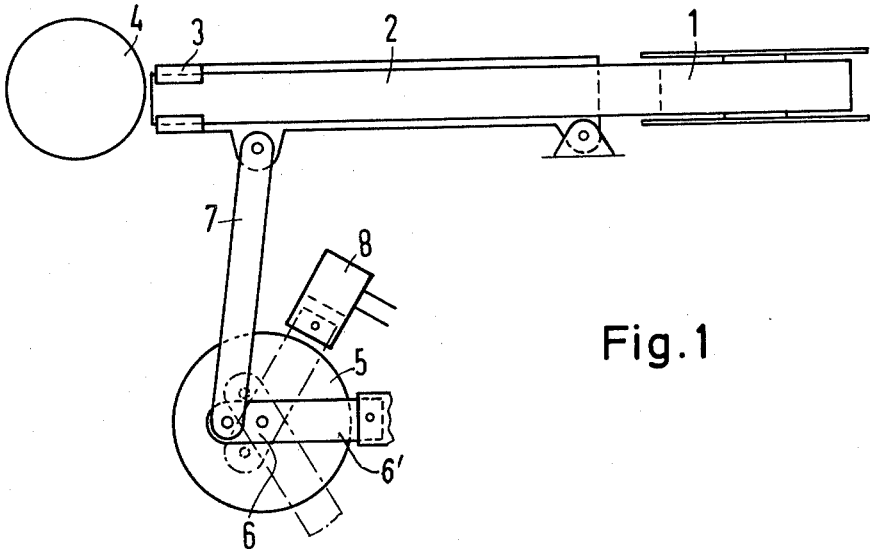
FIG. 1 illustrates one arrangement of effecting connection between a stepping motor and the ribbon guide.

From respective ribbon reels 1, only one of which is illustrated, the ribbon 2 is guided by a ribbon guide illustrated as being pivoted at its end adjacent the ribbon reel or spool 1, whereby the the opposite end, carrying ribbon guide elements 3, whereby the ribbon 2 at the printing station adjacent the platen 4 may be adjusted in any one of a plurality of positions relative to the printing station. The ribbon 2 may have two longitudinal printing areas, for example, an upper black area and a lower red area. In FIG. 1 the ribbon guide is illustrated in a position to dispose the black area of the ribbon in operating position at the printing station. By pivoting the ribbon guide upwardly, the end thereof carrying the guide elements 3 may be suitably positioned relative to the platen 4 to dispose the red area of the ribbon in operating position. In the construction of FIG. 1, a stepping motor 5 is connected over suitable coupling elements to the ribbon guide which, in such embodiment, comprise a crank or eccentric 6 secured to the drive shaft to the stepping motor and connected over a suitable connecting rod 7 to the ribbon guide. In the position illustrated, the ribbon guide is in the intermediate of its three positions. Illustrated in dotted lines are the positions which the crank 6 may assume when the guide member is in either its elevated or its lowered position relative to the intermediate position illustrated.

The crank 6 is provided with an extension or arm 6' which in the adjustment position providing visibility of the printing station, i.e. the lowermost position of the crank, is disposed in cooperable relation to a scanning element 8. Also, as shown, a second scanning element could be provided, only a portion of which is illustrated in FIG. 1, which would be cooperable with the arm when the crank is in the position illustrated in solid lines in FIG. 1.

Figure 2:
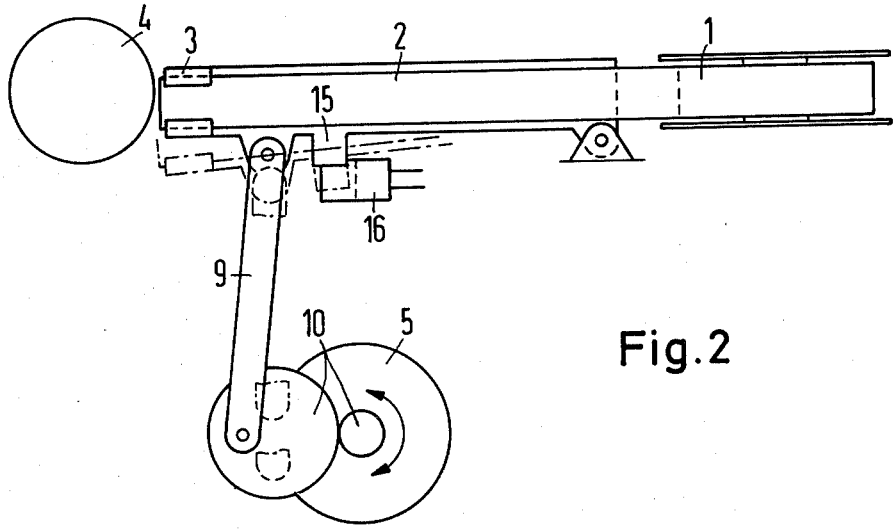
FIG. 2 illustrates a modified form of construction of such connecting means.

In the construction of FIG. 2, a connecting rod 9, generally corresponding to the connecting rod 7, is actuated by means of transmission gears 10, one of which is mounted on the drive shaft of the motor 5 and the other of which has the lower end of the connecting rod 9 eccentrically connected thereto.

Figure 3:
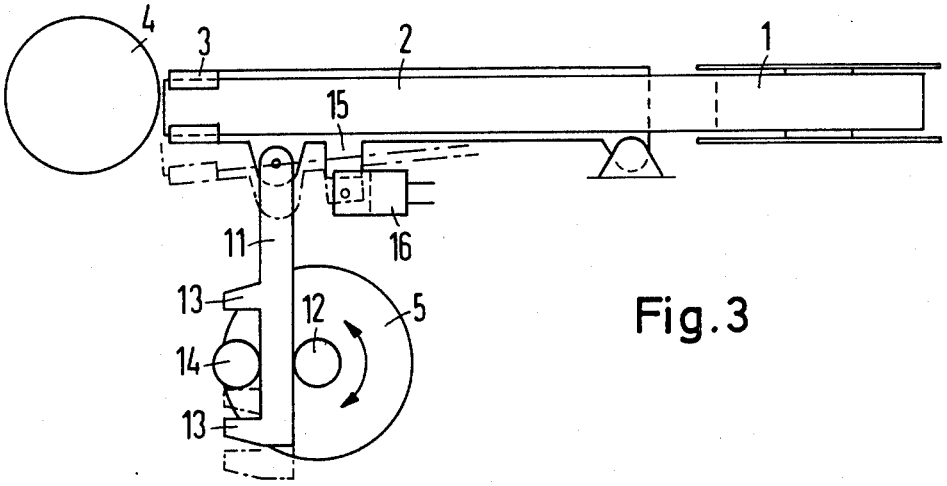
FIG. 3 illustrates a further modification of such a connecting means.

Likewise, in the construction illustrated in FIG. 3, a rack member 11 forms the connection between the stepping motor 5 and the ribbon guide, with the rack member being pivoted to the ribbon guide and carrying gear teeth which are meshed with a pinion gear 12, carried by the shaft of the stepping motor 5, which thus transmits the adjustment movements to the ribbon guide. Step means 13 carried by the rack member 11 and cooperable with a stationary pin 14 define the upper and lower end positions of the ribbon guide. The visibility position of the guide member is illustrated, in both FIGS. 2 and 3, in broken lines. Likewise, in both of these constructions, the ribbon guide is provided with suitable means, as for example, a projection 15 which is so disposed with respect to a scanning element 16 that it will cooperate with the latter for the formation of a suitable criterion, when the ribbon guide is in its lowermost position, as indicated by said broken lines. The constructions described are predicated on the assumption that the basic position of the ribbon should be that in which the upper useful track of the ribbon, in the present case the black portion of the ribbon, is disposed in operative position at the printing station and thus is the central adjustment position of the three-positions. The circuit arrangement illustrated in FIG. 4 is predicated upon this arrangement.

Figure 4:
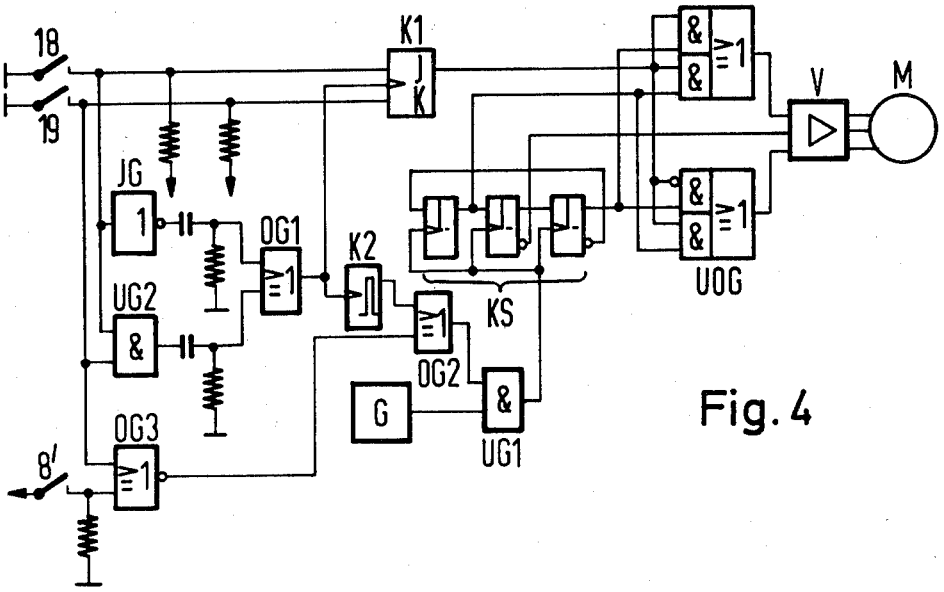
FIG. 4 is a schematic diagram of a drive circuit for controlling the operation of a stepping motor.

Referring to FIG. 4, the contact 18 is adapted to be closed when a printing operation is to be effected utilizing the lower ribbon track, i.e. for example, red ink, whereas the contact 19 is adapted to be closed to provide a visibility position, while the switch 8' represents the scanning element 8.

Assuming a printing operation is to be effected utilizing the lower ribbon track, i.e. for example, for red printing, the contact 18 is closed, as a result of which, due to the logic 1 occurring at the output of the inverter JG, the immediately following RC-element supplies a pulse over the OR-logic-linking gate OG1, as a control pulse train, both to a bistable JK-trigger stage K1 and to a monostable trigger stage K2. As a logic 0 is now present at the upper input J of the JK-trigger stage K1 and a logic 1 is present at the lower K input of such trigger stage, the latter is set at the inverting output. This provides the criterion for determining the direction of movement required to move the ribbon into the lower red area. At the same time, the monostable trigger stage K2 is set which supplies the requisite number of pulses of a pulse generator G, over an OR-logic-linking element OG2 and an AND-logic-linking element UG1, to the series of trigger stages KS, constructed as a Jonson counter. The stepping motor M is actuated over an amplifier stage V by means of the drive pulse trains emanating from the row of trigger stages KS of the counter which are logic-linked over AND/OR logic-linking elements UOG in accordance with the direction criterion which is derived at the output of the JK-trigger stage K1.

When the contact 18 is again closed, a pulse is produced, over the AND-logic-linking element UG2 and the following RC-element, and is again supplied to the JK-trigger stage K1 and to the monostable trigger stage K2. As the JK-trigger stage K1 now triggers into its reverse position, a criterion is obtained for the backwards motion of the stepping motor M, which now receives the same number of timing pulses from the pulse generator G for the backwards setting.

When the visibility of the printing station is desired, the contact 19 is closed whereby the drive of the stepping motor M is effected over an OR-logic-linking element OG3 which is additionally supplied with a criterion from the scanning element 8, or 16. When the contact 19 is closed, the JK-trigger stage K1 is actuated at the K input so that the trigger stage K1 supplies a criterion which results in the stepping motor M rotating in the reverse direction as with the actuation of the contact 18. As a result, a control signal is transmitted from the output of the OR-gate OG3 over OR-gate OG2 to AND-gate UG1, resulting in the passage of sufficient drive pulse trains from the generator G until the assumption of the visibility position is signalled by the closure of the contact 8' of the scanning element 8 or 16. Resetting from the visibility position to the basic position is achieved by re-opening contact 19, whereby the necessary timing pulses are received from the pulse generator G over the AND-logic-linking element UG2, the RC-element, the OR-logic-linking element OG1, the trigger stage K2, OR-logic-linking element OG2 and the AND-logic-linking element UG1. The JK trigger stage K1 is likewise reset so that the criterion for the corresponding-reverse direction of the stepping motor is provided.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a printing device having a printing station and a ribbon guide for supporting a laterally moving ribbon at said printing station, a device for selectively varying the position of said ribbon guide among a plurality of discrete positions comprising:

a stepping motor having a drive shaft;

a connector pivotally attached to said ribbon guide;

a means directly drivingly linking said connector and said drive shaft for translating rotary motion of said drive shaft to reciprocal vertical motion of said connector and guide;

a means for sensing the position of said ribbon guide; and a logic control circuit connected to said position sensing means for operating said motor supplying pulse trains thereto of selected length for producing corresponding vertical motion to position said ribbon guide, said circuit including a means for generating said pulse train and a means for determining the rotary direction of operation of said stepping motor, said control circuit operable in a first mode enabling said pulse generating means for a pre-determined period for alternatingly moving said ribbon guide through opposite pre-determined distances, or operable in a second mode for enabling said pulse generating means for a period which ends when a selected position is sensed by said position sensing means.

2. The printing device of claim 1 wherein said plurality of discrete positions is three and wherein one of said three positions is selected as a base position which is normally assumed by said ribbon guide, and wherein said logic control circuit contains switching gates for operating in said first mode or said second mode to move said ribbon guide to either of the remaining two positions.

3. A device according to claim 1, wherein said means for sensing the position of said ribbon guide is carried by and directly movable with said ribbon guide.

4. A device according to claim 1, wherein said means for sensing the position of said ribbon guide is carried by and movable with a portion of said connector nearest said stepping motor driveshaft.

* * * * *